US006116746A

United States Patent [19]

Hsu

[11] Patent Number: 6,116,746

[45] Date of Patent: Sep. 12, 2000

[54] TOOL HAVING A LIGHT DEVICE

[75] Inventor: Gin Tzou Hsu, Da Li, Taiwan

[73] Assignee: Chang-Hsing Yeh, Taichung, Taiwan

[21] Appl. No.: 09/175,094

[22] Filed: Oct. 19, 1998

[51] Int. Cl.[7] ..... B25B 23/18

[52] U.S. Cl. ..... 362/119; 362/109; 362/102

[58] Field of Search ..... 362/119, 109, 362/102

[56] References Cited

U.S. PATENT DOCUMENTS 5,899,554 5/1999 Hsu ..... 362/119

5,971,560 10/1999 Chen ..... 362/119

*Primary Examiner*—Darren E. Schuberg

*Assistant Examiner*—Fayez Assaf

*Attorney, Agent, or Firm*—Charles E. Baxley, Esq.

[57] ABSTRACT

A tool includes a handle having a driving stem for driving a fastener and having a chamber for receiving one or more batteries. A light bulb is received in the handle. A cover is secured to the handle for blocking the chamber. The cover includes an orifice for allowing a light generated by the light bulb to emit outward of the handle. A cap is pivotally coupled to the cover for selectively enclosing the orifice. The cap includes a conductor selectively actuated to engage with the light bulb when the cap is opened. The conductor may be disengaged from the light bulb when the cap is closed.

5 Claims, 3 Drawing Sheets

TOOL HAVING A LIGHT DEVICE

BACKGROUND OF THE INVENTION

1. Field of the Invention

The present invention relates to a tool, and more particularly to a tool having a light device.

2. Description of the Prior Art

Typical tools, such as the wrenches, or the screw drivers, have a light device and a switch for actuating the light device. However, the light device is not suitably shielded.

The present invention has arisen to mitigate and/or obviate the afore-described disadvantages of the conventional tools.

SUMMARY OF THE INVENTION

The primary objective of the present invention is to provide a tool having a shielding device for shielding the light device and for actuating the light device when the shielding device is opened.

In accordance with one aspect of the invention, there is provided a tool comprising a handle including a driving stem for driving a fastener and including a chamber formed therein and including an orifice communicating with the chamber, at least one battery received in the chamber of the handle, a light bulb received in the handle, the orifice of the handle being provided for allowing a light generated by the light bulb to emit outward of the handle, and means for selectively shielding the orifice and the light bulb.

The handle includes a cover secured thereto for blocking the chamber, the orifice is formed in the cover, the selectively shielding means includes a cap pivotally secured to the cover at a pivot shaft for allowing the cap to be rotated about the pivot shaft to enclose the orifice. The cover includes a socket secured thereto for receiving the light bulb, the socket includes an opening communicating with the orifice for allowing the light generated by the light bulb to emit outward of the handle via the orifice.

The selectively shielding means includes a selectively actuating means for selectively actuating the light bulb when the cap is opened. The cap includes a reflector member for reflecting the light generated by the light bulb. The selectively shielding means includes a means for locking the cap to the handle and includes a conductor having a first end secured to the cap and rotated in concert with the cap and having a second end for engaging with the light bulb, the second end of the conductor is actuated to engage with the light bulb when the cap is opened such that the light bulb may be automatically actuated and energized when the cap is opened and such that the light bulb may be automatically switched off when the cap is closed.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
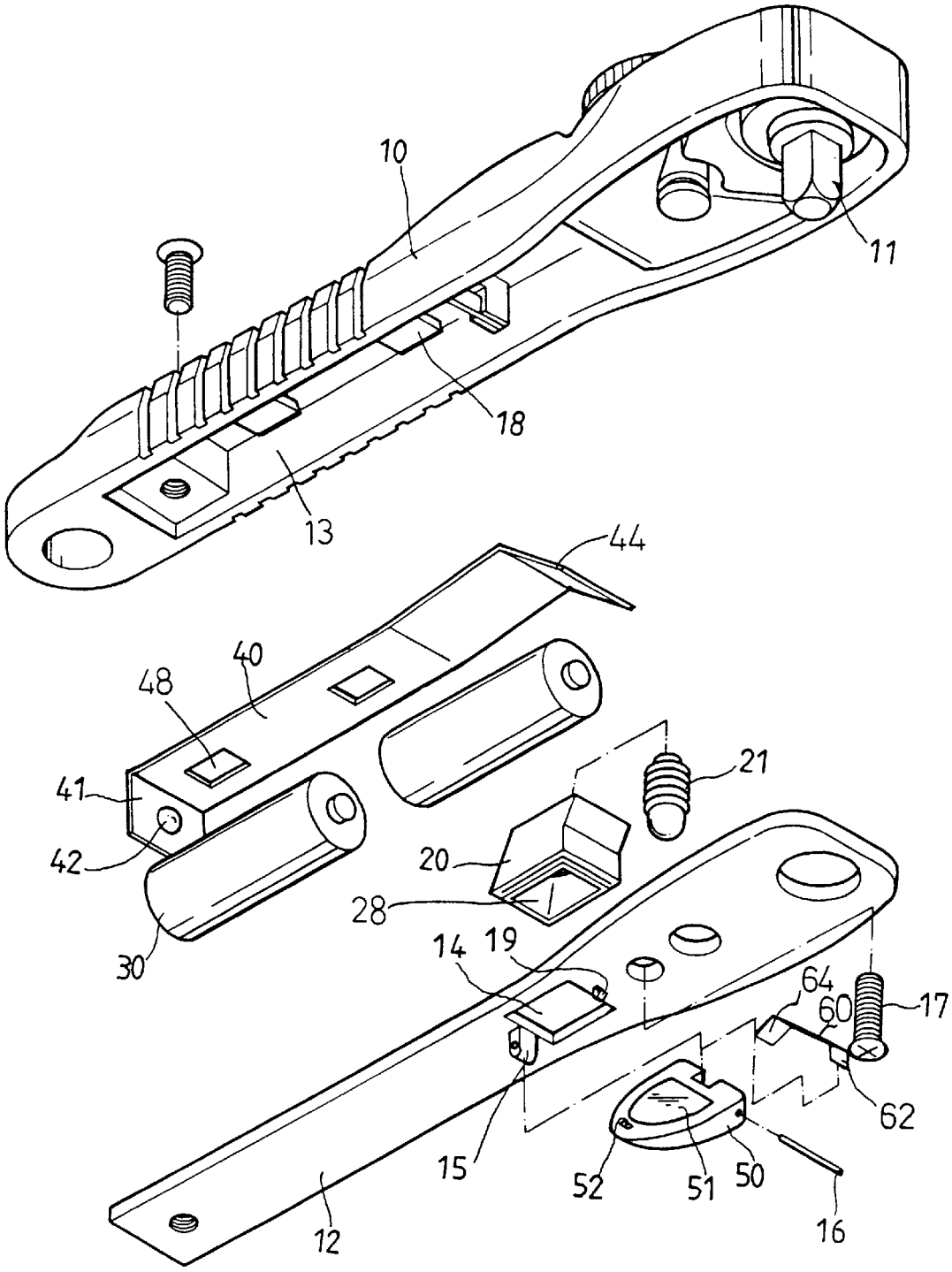
FIG. 1 is an exploded view of a tool in accordance with the present invention.
Figure 2:
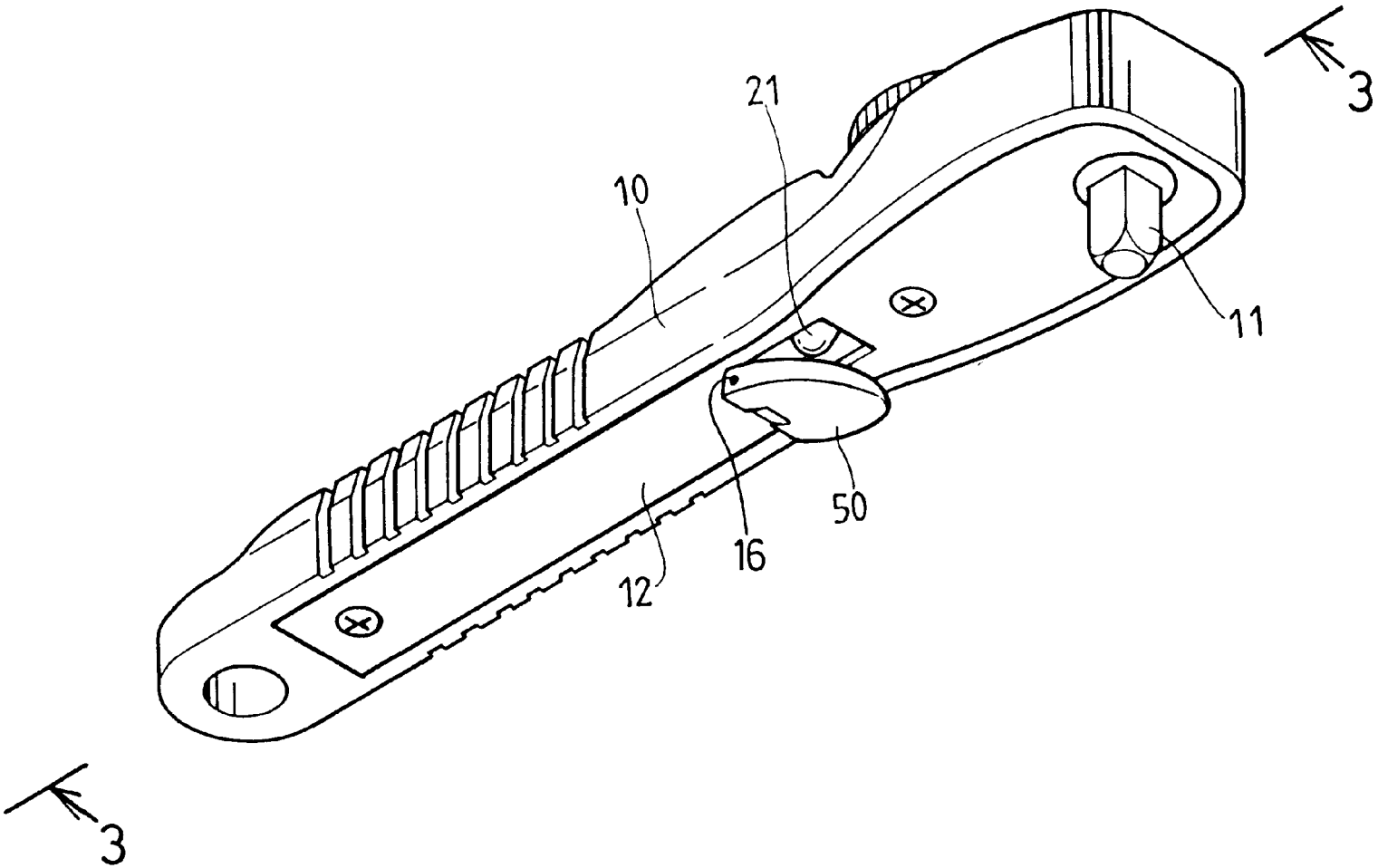
FIG. 2 its a perspective view of the tool.
Figure 3:
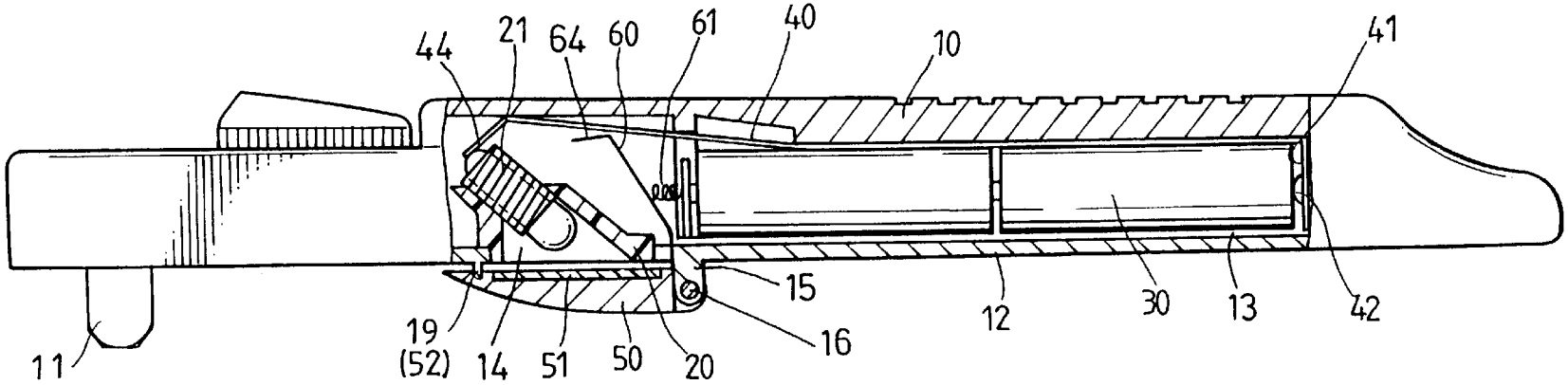
FIG. 3 is a cross sectional view taken along lines 3—3 of FIG. 2.

Referring to the drawings, and initially to FIGS. 1–3, a tool in accordance with the present invention comprises a handle 10 including a driving stem 11 secured in one end for engaging with and for driving the fasteners. The handle 10 may also include a ratchet mechanism for selectively controlling the operation directions of the tool. The handle 10 includes a chamber 13 formed therein for receiving one or more batteries 30 and a cover 12 secured to the handle 10 by such as one or more fasteners 17 for enclosing the chamber 13 and for retaining the batteries 30 and the other elements in the handle 10.

Figure 4:
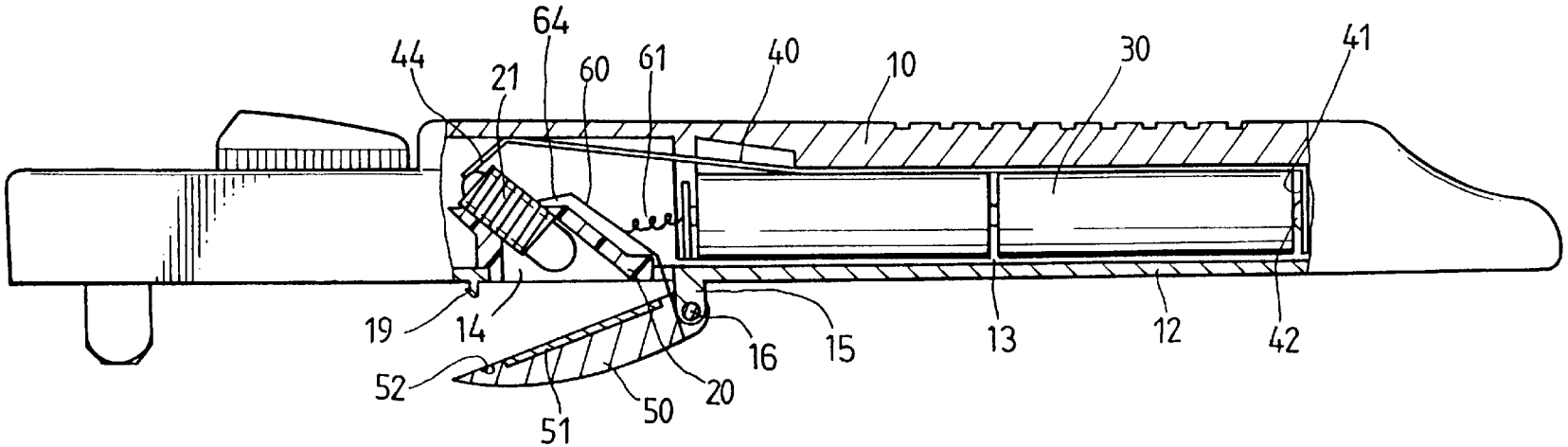
FIG. 4 is a cross sectional view similar to FIG. 3, illustrating the operation of the tool.

The cover 12 includes an orifice 14 and includes an ear 15 and a catch 19 extended downward therefrom. A socket 20 is secured to the cover 12 by such as force-fitted engagement or by welding process, and a light bulb 21 is engaged in the socket 20. The socket 20 includes an opening 28 communicating with the orifice 14 such that the light generated by the light bulb 21 may emit outward of the tool via the orifice 14. A conductor 40 includes a projection 42 extended from one end 41 for engaging with the case electrode of the batteries 30 and includes the other end 44 electrically coupled to the center electrode of the light bulb 21 (FIGS. 3, 4). The conductor 40 includes one or more punctures 48 for receiving one or more bulges 18 of the handle 10 by such as force-fitted engagement and for securing the conductor 40 to the handle 10.

A cap 50 is pivotally coupled to the ear 15 at a pivot shaft 16 for allowing the cap 50 to be rotated about the pivot shaft 16 and for allowing the cap 50 to enclose the orifice 14. The cap 50 includes an aperture 52 for receiving the catch 19 and for locking the cap 50 to the cover 12 such that the cap 50 may be used for enclosing the orifice 14. The cap 50 includes a reflector member 51 secured thereon for reflecting the light generated by the light bulb 21. Another conductor 60 has one end 62 secured to the cap 50 and rotated in concert with the cap 50 and has the other end 64 for selectively engaging with the case electrode of the light bulb 21. An electric wire or another conductor 61 electrically couples the conductor 60 to the center electrode of the batteries 30.

In operation, as shown in FIG. 3, the other end 64 of the conductor 60 is disengaged from the light bulb 21 when the cap 50 encloses the orifice 14 of the cover 12. As shown in FIG. 4, when the cap 50 is opened, the other end 64 of the conductor 60 is caused to engage with the case electrode of the light bulb 21 for allowing the batteries 30 to energize the light bulb 21 when the cap 50 is opened. The reflector member 51 may reflect the light of the light bulb 21 for increasing the lighting effect. Accordingly, the conductor 60 may be selectively actuated to actuate the light bulb 21 when the cap 50 is opened.

It is to be noted that the socket 20 is made of insulating materials as shown in FIGS. 3 and 4. Alternatively, the handle 10 and the cover 12 may be made of electric insulating materials and the socket 20 is made of electric conductible materials. In such a case, the other end 64 of the conductor 60 may also be operated to actuate the light bulb 21 by electrically contacting with the case electrode of the light bulb 21 via the socket 20. Further alternatively, the cover 12 may be taken as an integral part of the handle 10 or may be formed as an integral portion of the handle 10. The batteries 30 and the socket 20 and the other elements may be engaged into the handle 10 from one end of the handle 10.

Accordingly, the tool in accordance with the present invention includes a shielding device for shielding the light device and for actuating the light device when the shielding device is opened.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a driving stem for driving a fastener and including a chamber formed therein and including an orifice communicating with said chamber, said handle including a cover secured thereto for blocking said chamber, said orifice being formed in said cover, at least one battery received in said chamber of said handle, a light bulb received in said handle, said orifice of said handle being provided for allowing a light generated by said light bulb to emit outward of said handle, and means for selectively shielding said orifice and said light bulb, said selectively shielding means including a cap pivotally secured to said cover at a pivot shaft for allowing said cap to be rotated about said pivot shaft to enclose said orifice, wherein said cover includes a socket secured thereto for receiving said light bulb, said socket includes an opening communicating with said orifice of said cover for allowing the light generated by said light bulb to emit outward of said handle via said orifice.

2. The tool according to claim 1, wherein said selectively shielding means includes a cap pivotally secured to said handle at a pivot shaft for allowing said cap to be rotated about said pivot shaft to enclose said orifice and includes a selectively actuating means for selectively actuating said light bulb when said cap is opened.

3. The tool according to claim 2, wherein said cap includes a reflector member for reflecting light.

4. The tool according to claim 2, wherein selectively shielding means includes a means for locking said cap to said handle.

5. The tool according to claim 2, wherein said selectively actuating means includes a conductor having a first end secured to said cap and rotated in concert with said cap and having a second end for engaging with said light bulb, said second end of said conductor is actuated to engage with said light bulb when said cap is opened.

* * * * *